US006696791B2

(12) United States Patent
Raiser et al.

(10) Patent No.: US 6,696,791 B2
(45) Date of Patent: Feb. 24, 2004

(54) METHOD FOR STARTING A DISCHARGE LAMP

(75) Inventors: Franz Raiser, München (DE); Bernhard Reiter, München (DE)

(73) Assignee: Patent-Treuhand-Gesellschaft fur elektrische Gluhlampen mbH, Munich (DE)

( * ) Notice: Subject to any disclaimer, the term of this patent is extended or adjusted under 35 U.S.C. 154(b) by 0 days.

(21) Appl. No.: 10/119,746

(22) Filed: Apr. 11, 2002

(65) Prior Publication Data

US 2002/0175629 A1 Nov. 28, 2002

(30) Foreign Application Priority Data

May 28, 2001 (DE) ..... 101 26 011

(51) Int. Cl.[7] ..... H05B 41/36
(52) U.S. Cl. ..... 315/94; 315/291; 315/209 R; 315/224

(58) Field of Search ..... 315/94, 96, 97, 315/105, 106, 107, 224, 291, 307, 209 R

(56) References Cited

U.S. PATENT DOCUMENTS 5,656,891 A * 8/1997 Luger et al. ..... 315/94
5,986,408 A * 11/1999 Langeslag et al. ..... 315/94
6,252,357 B1 * 6/2001 Tanaka et al. ..... 315/209 R
6,433,490 B2 * 8/2002 Koch et al. ..... 315/224

* cited by examiner

*Primary Examiner*—James Clinger
*Assistant Examiner*—Ephrem Alemu

(57) ABSTRACT

A method for starting a discharge lamp having two filaments includes the following steps: (1) preheating only one of the two filaments; (2) igniting the lamp; (3) operating the lamp with a direct current; and (4) powering the lamp with an alternating current. The step of operating the lamp with a direct current has a duration that is preferably between 0.1 seconds and 2 seconds.

3 Claims, 1 Drawing Sheet

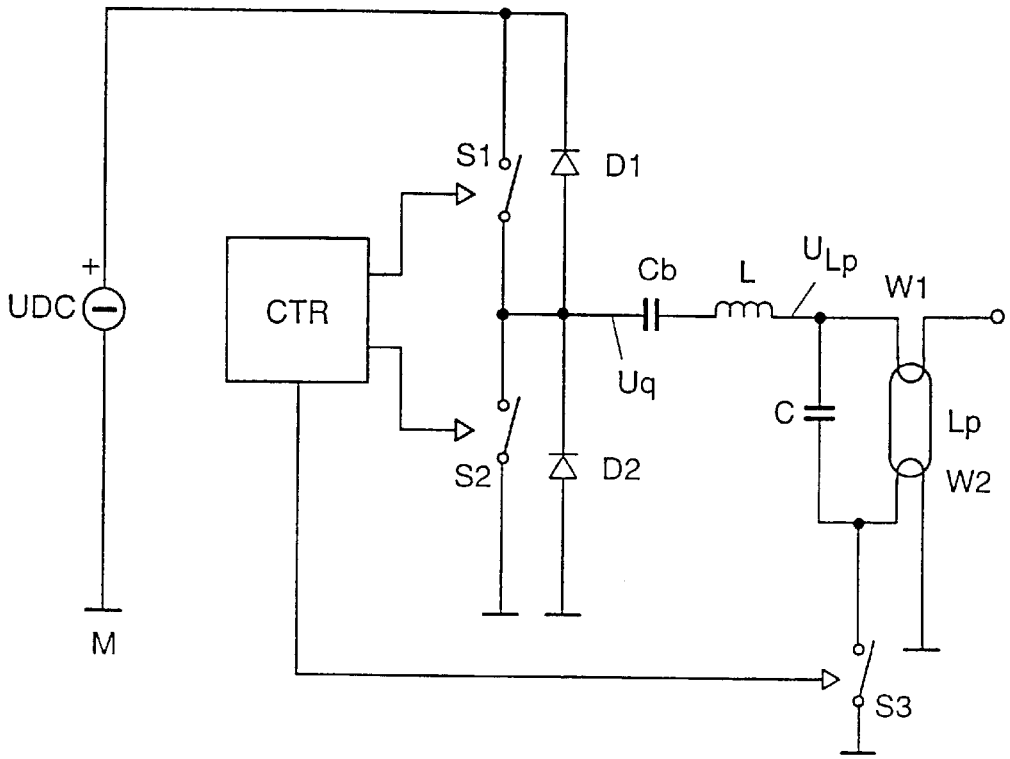
S1
D1
+
UDC
CTR
Cb
L
$U_{Lp}$
W1
Uq
C
Lp
S2
D2
W2
M
S3

METHOD FOR STARTING A DISCHARGE LAMP

TECHNICAL FIELD

The present invention relates to the general subject of ballasts for powering gas discharge lamps. More particularly, the present invention relates to a method for starting a discharge lamp.

BACKGROUND ART

Discharge lamps, in particular low-pressure discharge lamps, which are termed lamps below for short, frequently have electrodes that are designed as electrode filaments.

The starting of such a lamp is described below. It can be subdivided into 3 phases:

1. Preheating—for this purpose, the electrode filaments are flowed through by a preheating current and heated up thereby. The electron work function at the electrode filaments is thereby reduced.
2. Ignition—an igniting voltage that initiates the gas discharge in the lamp is applied to the lamp for this purpose. This may be a DC or AC voltage. A resonant ignition is customary in the case of electronic operating devices for low pressure discharge lamps, for which reason the igniting voltage is mostly an AC voltage in this instance.
3. Operation—an operating current is applied to the lamp after the ignition. The operating current must be an alternating current, since separation of the gas or plasma in the lamp otherwise occurs. In the case of customary low-pressure discharge lamps, positively charged mercury ions play an important role in the generation of light. Direct current would cause the mercury ions to accumulate at the cathode, and light would no longer be generated at the anode. An alternating current with a frequency in the range of from 30 kHz to 150 kHz is applied to the lamp in the case of commercially available electronic operating devices.

The preheating is important for the following reason: if an electrode filament is cold, it forms a high cathode fall for the emission of electrons, that is to say for the case in which it acts as cathode. This cathode fall effects a considerable acceleration of incoming mercury ions. The mercury ions striking the electrode filament with high energy lead to rapid wear of the electrode filament, and thus to a short service life of the lamp.

The preheating therefore constitutes a quality feature for a high-quality electronic operating device. However, the implementation of the preheating in terms of circuitry means a substantial outlay, which constitutes a substantial part of the costs of the operating device. What complicates the implementation of the preheating in terms of circuitry is the fact that the electrode filaments to be heated lie at different ends of the lamp. That is to say, the circuit components for heating the two electrode filaments must be designed such that they allow an igniting voltage to pass to the lamp and also withstand it without being damaged.

DISCLOSURE OF THE INVENTION

It is an object of the present invention to provide a method in which the electrode filaments of a discharge lamp can be preheated easily and cost-effectively.

According to the invention, only one of the two electrode filaments of a lamp are preheated, in order to reduce the outlay on circuitry.

As set forth in the section relating to the prior art, an electrode filament is damaged only when it is cold and momentarily acts as a cathode. In the case of ignition with the aid of an AC voltage, the ignition will take place when that electrode which was preheated is momentarily the cathode, because in this state the voltage required for ignition is at its lowest. It follows that the ignition process itself does not cause any damage to the electrode filament which is not preheated in accordance with the invention. Also possible is an ignition with the aid of DC voltage, in the case of which the non-preheated electrode filament acts as anode. In this case, as well, the ignition process does not cause any damage to the electrode filament that is not preheated in accordance with the invention.

During operation following the ignition, however, a non-preheated electrode filament is always damaged when it is momentarily the cathode. According to the invention, the operation of the lamp is subdivided into two subphases. In the first subphase following the ignition, direct current is applied to the lamp in accordance with the invention, the non-preheated electrode filament acting as anode. Since the anode is not exposed to the bombardment of the mercury ions, it is also not damaged when it has not been preheated. The non-damaging electron bombardment heats up an anode in operation of the lamp. That is to say, the non-preheated electrode filament is heated up in the first subphase of operation. If this electrode filament has reached a temperature that also permits non-damaging operation as cathode, the first subphase of the operation ends in accordance with the invention. In the second subphase of the operation, following thereupon, alternating current is applied to the lamp. The second subphase corresponds to the normal operation of the lamp. The first subphase according to the invention is of such a short duration that the abovementioned separation effects do not occur. After at most 2 seconds, the non-preheated electrode filament operated as anode is at a temperature level that permits damage-free operation as cathode.

As already mentioned, the preheating according to the invention of only one electrode filament leads to a substantial reduction in the outlay on circuitry. Since there is a free choice of the electrode filament that is preheated, that electrode filament is preheated which requires the least outlay on circuitry because of its ground reference. The preheating of the electrode filament without ground reference generally requires a higher outlay on circuitry. This can be eliminated according to the invention.

The advantage of the present invention resides, however, not only in the reduction of the outlay on circuitry, but also in a reduction in the outlay on connecting the lamp. Usually, a lamp with two electrode filaments has four terminals. If both electrode filaments are preheated, it is necessary for four connecting wires to be run to the lamp. However, three connecting wires suffice if only one electrode filament is preheated according to the invention. Only the electrode filament that is preheated is connected at its two terminals. One connecting wire suffices for the non-preheated electrode filament.

The description of the invention is largely restricted to one lamp. However, the idea of the invention can also be extended to starting a plurality of lamps in the way according to the invention.

BRIEF DESCRIPTION OF THE DRAWINGS

The FIGURE describes an electronic operating device for carrying out a method for starting a discharge lamp, in accordance with a preferred embodiment of the present invention.

DETAILED DESCRIPTION OF THE PREFERRED EMBODIMENTS

The invention is to be explained in more detail below with the aid of an exemplary embodiment. The FIGURE shows the outline circuit diagram of an electronic operating device with the aid of which the method according to the invention can be carried out.

An AC voltage generator that is designed as a half-bridge inverter forms the core of the electronic operating device. It comprises the series circuit of the electronic half-bridge switches S1 and S2, which are driven by a control unit CTR. The series circuit of the electronic half-bridge switches S1 and S2 is connected to a DC voltage source UDC for the supply of energy. Reference potential is the potential M that is connected to the negative pole of the DC voltage source UDC. Each half-bridge switch S1 and S2 is connected in parallel to a freewheeling diode D1 and D2. They are polarized such that the cathode points in each case in the direction of the positive pole of the DC voltage source. The output of the AC voltage generator is located at the connecting point of the electronic switches S1 and S2, where the source voltage Uq is present. The load circuit is connected between the source voltage Uq and reference potential M. It comprises the series circuit of a coupling capacitor Cb, an inductor L, a capacitor C and an electronic heating control switch S3. The coupling capacitor Cb serves for decoupling the direct component of the source voltage Uq. The inductor L and the capacitor C form a series resonance with the resonant frequency fres. Connected in parallel with the capacitor C is the output of the load circuit to which a lamp Lp is connected. A lamp voltage ULp is also tapped there.

The lamp has two filaments W1 and W2, which each have two terminals. The lamp is connected to the capacitor C such that one terminal of the electrode filament W1 is connected to one terminal of the capacitor C, and one terminal of the electrode filament W2 is connected to the other terminal of the capacitor C. The other terminal of electrode filament W1 remains unconnected in accordance with the invention. The other terminal of the electrode filament W2 is connected to the reference potential M.

The control unit CTR also controls the heating control switch S3. The latter need not be designed for the igniting voltage of the lamp Lp of several hundred volts. Rather, a voltage endurance of at most 50 volts suffices. The control unit CTR preferably includes a microcontroller. It is thereby possible for the starting process to be stored in a computer program and, if appropriate, to be easily adapted to other types of lamp.

The half-bridge switches S1 and S2 are alternately switched on and off at a high preheating frequency for the purpose of preheating. The heating control switch S3 is open. Consequently, the electrode filament W2 is preheated via the capacitor C. The preheating frequency must be selected to be so high that there is set up via the capacitor C a sufficiently high preheating current that heats the electrode filament W2 up in approximately one second to a temperature that permits ignition largely free from damage.

After the preheating phase, the heating control switch S3 is closed, and the frequency at which the half-bridge switches S1 and S2 are switched on and off alternately is lowered to the resonant frequency of the series resonant circuit comprising the inductor L and the capacitor C. As a result, an igniting voltage that causes the lamp to ignite is built up at the lamp Lp.

The first subphase of operation begins after the ignition. For this purpose, the half-bridge switch S2 remains open, and only the half-bridge switch S1 is switched on and off. Consequently, a direct current is fed to the lamp Lp, the non-preheated electrode filament W1 acting as anode according to the invention. It is to be noted that the value of the capacitance of the coupling capacitor Cb is selected to be so high that the voltage across the coupling capacitor Cb does not change substantially during the first subphase of operation.

The second subphase of operation begins after at most 2 seconds. The half-bridge switches S1 and S2 are switched on and off alternately again in this phase. An alternating current is fed to the lamp Lp as a result.

The heating control switch S3 remains closed during the operating phase. No heating current flows through the electrode filament W2 during the opeating phase as a result. Consequently, overheating of the filament W2 is avoided and the efficiency of the operating device is raised. According to the invention, current never flows through the electrode filament W1.

What is claimed is:

1. A method for starting a discharge lamp having two preheatable electrode filaments, comprising the steps of:

preheating only one of the two preheatable electrode filaments;

igniting the discharge lamp after preheating only one of the two preheatable electrode filaments;

operating the discharge lamp with a direct current for a predetermined period of time after igniting the discharge lamp; and providing an alternating current to the discharge lamp after operating the discharge lamp with a direct current for the predetermined period of time.

2. The method as claimed in claim 1, characterized in that the predetermined period of time has a duration of between 0.1 second and 2 seconds.

3. The method as claimed in claim 1, characterized in that direct or alternating current flows through the lamp during the step of igniting.

* * * * *